US005417173A

United States Patent [19]

Mitsuji

[11] Patent Number: 5,417,173

[45] Date of Patent: May 23, 1995

[54] METHOD OF CUTTING THREADS IN A SEWING MACHINE AND DEVICE FOR PERFORMING THE SAME

[75] Inventor: Toshiro Mitsuji, Toyonaka, Japan

[73] Assignee: Yamato Mishin Seizo Kabushiki Kaisha, Osaka, Japan

[21] Appl. No.: 304,429

[22] Filed: Sep. 12, 1994

[30] Foreign Application Priority Data

Oct. 24, 1991 [JP] Japan ..... 3-306582

[51] Int. Cl.[6] ..... D05B 1/00; D05B 65/00

[52] U.S. Cl. ..... 112/262.1; 112/286; 112/291

[58] Field of Search ..... 112/291, 293, 294, 295, 112/296, 297, 298, 262.1, 274, 275, 285, 286, 166

[56] References Cited

U.S. PATENT DOCUMENTS

| | | | |
|---|---|---|---|
| 2,376,417 | 5/1945 | Chudner | 112/291 |
| 2,846,967 | 8/1958 | Doerr et al. | 112/291 |
| 3,424,115 | 1/1969 | Schopf | 112/296 |
| 4,098,208 | 7/1984 | Hedgegaard | 112/291 |
| 4,448,139 | 5/1984 | Dorosz | 112/274 |
| 4,461,229 | 7/1984 | Angele et al. | 112/297 X |
| 4,630,559 | 12/1986 | Kinoshita | 112/291 |
| 4,879,960 | 11/1989 | Prais | 112/291 |
| 5,015,750 | 4/1992 | Horie | 112/291 X |
| 5,042,408 | 8/1992 | Suzuki et al. | 112/262.1 X |
| 5,078,068 | 1/1992 | Hager et al. | 112/275 |
| 5,125,351 | 6/1992 | Prais et al. | 112/262.1 X |
| 5,133,272 | 7/1992 | Hayashi | 112/291 X |
| 5,138,961 | 8/1992 | Nakano et al. | 112/291 |
| 5,144,900 | 9/1992 | Takahashi | 112/275 |
| 5,146,862 | 9/1992 | Sato et al. | 112/275 |

FOREIGN PATENT DOCUMENTS

| | | |
|---|---|---|
| 1485424 | 7/1969 | Germany . |
| 7521082 | 7/1975 | Germany . |
| 63-139879 | 9/1988 | Japan . |
| 63-214277 | 9/1988 | Japan . |
| 63-262182 | 10/1988 | Japan . |

*Primary Examiner*—Clifford D. Crowder
*Assistant Examiner*—Larry D. Worrell, Jr.
*Attorney, Agent, or Firm*—Darby & Darby

[57] ABSTRACT

When needle threads that move vertically together with a plurality of needles which move vertically to pass through a throat plate positioned on a cylinder bed, and a looper thread that is caused to intertwist with the needle threads by a looper which reciprocates in accordance with the vertical motion of the needles are to be cut, the needles are stopped at the bottom dead point or in the vicinity thereof and the looper thread is cut, and then the needles are stopped at the top dead point or in the vicinity thereof and the needle threads are collectively cut.

16 Claims, 13 Drawing Sheets

METHOD OF CUTTING THREADS IN A SEWING MACHINE AND DEVICE FOR PERFORMING THE SAME

This is a continuation of application Ser. No. 07/956,917, filed Oct. 5, 1992, now abandoned.

BACKGROUND OF THE INVENTION

1. Field of the Invention

This invention relates to a method of cutting needle threads and a looper thread in interlocking with the stoppage of the sewing operation in a multi-needle covering chainstich sewing machine with a cylinder bed, and also to a thread trimming device which is useful for performing the method.

2. Description of the Related Art

FIG. 1 is a view illustrating sewing steps performed in a multi-needle covering chainstich sewing machine. The multi-needle covering chainstich sewing machine has a plurality of needles 1 which are arranged in parallel in the front side of a throat plate disposed on a bed (not shown), and a looper 2 in the rear side of the throat plate. In the sewing machine, the sewing operation is performed on a material fabric A which is fed on the upper face of the throat plate along a direction orthogonal to the arrangement direction of the needles 1.

The needles 1 and needle threads la passing through the tip of the respective needles 1 as shown in the figure reciprocate vertically with the operation of feeding the material fabric A, in a predetermined moving stroke which penetrates the upper and lower faces of the throat plate. The looper 2 has a working rod 2*b* through which a looper thread 2*a* is passed from the rear end to the front end of the rod as shown in the figure. The looper 2 performs a rotational motion over a predetermined angle range and about a rotational axis which elongates along the feeding direction of the fabric A. This rotational motion is caused in interlocking with the feed of the fabric A. In this rotational motion, the working rod 2*b* moves or swings along the given circumference of a circle, the center of which is the rotational axis, to reciprocate along the parallel-arrangement line of the needles 1.

FIG. 1(*a*) shows the state in which the needles 1 are at the lowest position (bottom dead point), and FIG. 1(*c*) the state in which the needles 1 are at the highest position (top dead point). FIG. 1(*b*) shows the transition state from the bottom dead point to the top dead point, and FIG. 1(*d*) shows that from the top dead point to the bottom dead point. As seen from these figures, the working rod 2*b* performs one advance motion while the needles 1 move upward, and one retracting motion while the needles 1 move downward. The fabric A is intermittently fed by a predetermined length every downward movement of the needles 1, i.e., every transition from FIG. 1(*c*) to FIG. 1(*d*).

In the part of the process from FIG. 1(*a*) to FIG. 1(*c*) via FIG. 1(*b*), loops of needle threads 1*a* are formed directly under the needles 1 with the upward motion thereof, respectively. The working rod 2*b* which advances during this process is inserted into these loops, together with the looper thread 2*a* passed through the rod. As a result, in the state of FIG. 1(*c*) wherein the needles 1 reach the top dead point, the respective needle threads 1*a* are temporarily arrested by the working rod 2*b* of the looper 2.

In contrast, in the process from FIG. 1(*c*) to FIG. 1(*a*) via FIG. 1(*d*), the needle threads 1*a* arrested by the working rod 2*b* of the looper 2, and the looper thread 2*a* passed through the working rod 2*b* are caused to be respectively pulled out in a relative manner by the length corresponding to the one feeding length, by the operation of feeding the material fabric A which is performed during this process. In this case, the looper thread 2*a* is obliquely pulled out from the rear end of portions of intertwisting with the needle threads 1*a* and toward the front end of the working rod 2*b*, so as to form a triangle as shown in FIG. 1(*d*). During this process, the needles 1 which move downward after passing through the material fabric; A are sequentially passed through the vertex area of the triangle formed by the looper thread 2*a*, and then rectangular areas which are defined by the respective needle threads 1*a* and the looper thread 2*a*, so that, as shown in FIG. 1(*a*), the looper thread 2*a* is pulled out from the working rod 2*b* of the looper 2 which retracts at this time. The needles 1 hold the looper thread 2*a* in the state in which the needles 1 are passed through the loops formed by the needle threads 1*a*.

By repeating the above-mentioned operations, on the front side of the fabric A, parallel seams of the needle threads 1*a* are formed, and, on the back side of the fabric A, seams are formed as shown in FIG. 1 in which the loops of the needle threads 1*a* passing to the back side of the fabric A are correspondingly related with the looper thread 2*a* passing through the loops and intertwisted with them. FIG. 1 shows the stitch configuration in which top cover seaming is formed also on the front side of the fabric A. The top cover seaming on the front side is formed by the operation of a top cover thread looper 3 which moves as illustrated with the vertical motion of the needles 1.

In order to improve the sewing efficiency, such a multi-needle covering chainstich sewing machine for forming stitches as described above is generally provided with a thread trimming device which moves with the completion of a series of sewing operations to collectively cut the needle threads 1*a* and the looper thread 2*a*. The thread trimming device includes a fixed knife which has an edge facing the passing route of the needle threads 1*a* and is fixed to the lower face of the throat plate, and a movable knife which reciprocates in the arrangement direction of the needle threads 1*a* while sliding along the fixed knife.

The movable knife has engaging claws at its front end and middle portion which cooperate with the edge of the fixed knife to perform the shearing operation when retracting. The movable knife conducts one reciprocating motion at the time that the needles 1 are stopped at the top dead point after the sewing operations are ended. The needle threads 1*a* and looped thread 2*a* at the top dead point are shown in FIG. 1(*c*). Under this state, the movable knife enters from the side of the working rod 2*b* into the loops of the needle threads 1*a* through which the working rod 2*b* of the looper 2 has been passed. The engaging claw which is disposed at the front end and elongates to the vicinity of the front end of the working rod 2*b* engages with the looper thread 2*a*, and the engaging claw disposed at the middle portion engages with the innermost needle thread 1*a*. Thereafter, the movable knife retracts along the advance motion route to return to the initial position wherein the engaging claw disposed at the front end overlaps with the edge of the fixed knife.

During this retracting motion, the plural needle threads 1*a* are collectively pulled out by the engaging claw disposed at the middle portion of the movable knife, and the looper thread 2*a* is pulled out by the engaging claw disposed at the front end. These pulled out threads are cut by the shearing action of the edge of the fixed knife. Since this retracting motion is terminated when the movable knife returns to the initial position, the looper thread 2*a* which has been pulled out by the engaging claw disposed at the front end remains to be pressingly held between the fixed and movable knives after the cutting operation, and therefore there is no fear that the looper thread 2*a* slips off the working rod 2*b* of the looper 2. This eliminates the necessity of setting again the looper thread 2*a* to the looper 2 for the next sewing operation.

When the needles 1 are at the top dead point, a thread tension releasing mechanism (not shown) works with the motion of the needles 1 to relax the tension applied to the needle threads 1*a* and looper thread 2*a*, so that the afore-said pulling out operation accompanied with the next feed of the material fabric A can be done. This allows the afore-said pulling out operation for cutting these threads to be performed without causing any problem.

Commercially manufactured multi-needle covering chain-stich sewing machines are provided with a bed which has a shape selected from a wide variety of shapes according to the kind of the products to be sewn. For the purpose of sewing a raglan sleeve, for example, multi-needle covering chainstich sewing machines with a cylinder bed of a small diameter sufficient for being inserted into the sleeve are widely used.

In a case that such a multi-needle covering chainstich sewing machine with a cylinder bed is to be further provided with a thread trimming device such as described above, however, it is often that there is not sufficient space for additionally installing a movable knife and a mechanism for driving it, in the bed which is positioned under the throat plate and in which the looper 2 moves. To cope with this, therefore, it is required to improve the configuration.

A thread trimming device for a sewing machine of this kind, i.e., for a multi-needle covering chainstich sewing machine with a cylinder bed is disclosed in Japanese Utility Model Application Laid-Open No. 63-139879 (1988). This thread trimming device employs a movable knife which has a hook-like curved shape and is provided with one engaging claw at its front end. The base end portion of the movable knife is rotatably supported at the lower face of the throat plate and in the downstream of the needle drop points, so that the movable knife is swingable about the supporting axis in a plane parallel to the throat plate. An operating end of an actuator such as an air cylinder which reciprocates in the direction of the axis of the cylinder bed is engaged with the vicinity of the supporting axis, so that the movable knife is swung by the operation of the actuator.

In the same manner as the usual thread trimming device described above, the improved thread trimming device starts its operation under the state that the needles 1 are stopped at the top dead point. Initially, the movable knife advances along its curved line with the advance operation of the actuator, and enters into loops of the needle threads 1*a* which are arranged under the needle drop points as shown in FIG. 1(*c*). At this time, the engaging claw disposed at the front end of the movable knife engages with the innermost needle thread 1*a*. Then, owing to the retracting motion of the actuator which follows the advance motion, the other needle threads 1*a* and the looper thread 2*a* are collectively arrested by the engaging claw disposed at the front end of the movable knife, to be pulled out. These needle threads 1*a* and looper thread 2*a* are cut by the combination of the movable knife and the fixed knife which slidingly contacts with the movable knife at the end of the retraction route, and then pressingly held between the knives.

In the thread trimming device, the movable knife is driven by the actuator which may be appropriately disposed on the extension line of the axis of the cylinder bed, and the space to be prepared at the back side of the throat plate is that required for the swing motion of the arcuate movable knife which is performed within a predetermined angle range and along the curved line of the movable knife. Therefore, the thread trimming device can be installed inside the cylinder bed of a small diameter, which leaving plenty of empty space, but has drawbacks described below.

The cut needle threads 1*a* which are pressingly held between the movable knife and the fixed knife are pulled out from their respective held positions by the removal of the fabric A which has been subjected to the sewing operation. In this case, also the looper thread 2*a* which is pressingly held together with the needle threads 1 may be pulled out, with the result that the looper thread 2*a* may slip off the working rod 2*b* of the looper 2 at the start of the next sewing operation. When this happens, it is impossible to form seams and the sewing operation must be stopped. Therefore, it is necessary to take an adequate action for preventing the looper thread 2*a* from slipping off the looper 2.

In a sewing machine with a cylinder bed of a small diameter, the motion range of the looper 2 is restricted, and therefore a working rod 2*b* having a large curvature such as shown in FIG. 1 cannot be used. To comply with this, the front end of the working rod 2*b* is positioned below loops formed by the needle threads 1*a*, so that the front end of the movable knife which is passed through these loops as described above is positioned above the looper thread 2*a* elongating from the front end of the working rod 2*b*. Accordingly, the engaging claw disposed at the middle portion can engage with the needle threads 1*a*, but the engaging claw disposed at the front end cannot engage with the looper thread 2*a*.

Japanese Patent Applications Laid-Open No. 63-214277 (1988) and No. 63-262182 (1988) discloses thread trimming devices wherein a movable knife which has the substantially same curvature as the working rod 2*b* of the looper 2 and is curved in the direction of thickness is swingingly arranged on an axis that is coaxial with the rotation axis of the looper 2, a fixed knife is disposed in the route of the swing motion, and the movable knife performs one reciprocating motion under the state that the needles 1 are stopped at the top dead point, thereby cutting the needle threads 1*a* and looper thread 2*a*.

According to this configuration, the movable knife moves along the working rod 2*b* of the looper 2, and therefore the looper thread 2*a* can be surely arrested by the front end of the working rod 2*b*. However, the above-discussed problem that, when the needle threads 1*a* are pulled out with the removal of the material fabric A, also the looper thread 2*a* which is pressingly held together with the needle threads 1*a* may be pulled out and the next sewing operation is hindered, remains to be solved.

SUMMARY OF THE INVENTION

It is an object of the invention to provide a method of cutting threads in which needle threads and a looper thread can be-surely cut in a multi-needle covering chainstich sewing machine with a cylinder bed, and a thread trimming device for performing the method.

It is another object of the invention to provide a method of cutting threads in which a cut looper thread can be surely held, and a thread trimming device for performing the method.

It is a further object of the invention to provide a method of cutting threads which does not hinder the reduction of the diameter of a cylinder bed, and a thread trimming device for performing the method.

The method of cutting threads in a sewing machine according to the invention, wherein needle threads and a looper thread are cut inside a cylinder bed for providing a feed operation in the axial direction and at the top dead point and the bottom dead point of a plurality of needles or in the vicinity thereof where no influence is exerted upon the cut operation, the needle threads moving vertically together with the needles which move vertically to pass through the upper and lower faces of a throat plate which is positioned on the cylinder bed, the looper thread being caused to intertwist with the needle threads by a looper which reciprocates under the throat plate in accordance with the vertical motion of the needles, has the steps of: cutting the looper thread in a state that the needles are stopped at the bottom dead point or in the vicinity thereof; and cutting collectively the needle threads in a state that the needles are stopped at the top dead point or in the vicinity thereof.

The thread trimming device for a sewing machine according to the invention has: a cylinder bed for providing a feed operation in the axial direction; a plurality of needles which move vertically to pass through the upper and lower faces of a throat plate positioned on the cylinder bed; a looper reciprocating under the throat plate in accordance with the vertical motion of the needles; a first fixed knife having an edge which faces a working end of the looper when the looper is in the retracting state; a second fixed knife having an edge which faces the vertical motion route of the needles; a first movable knife for reciprocating in accordance with the stop of the needles at the bottom dead point or in the vicinity thereof, arresting a looper thread in the vicinity of the working end of the looper to pull out the looper thread, cutting the looper thread, and pressingly holding the looper thread while cooperating with the first fixed knife; and a second movable knife for reciprocating in accordance with the stop of the needles at the top dead point, or in the vicinity thereof, entering into loops formed by a plurality of needle threads when advancing, arresting collectively the needle threads to pull out the needle threads when succeedingly retracting, and cutting the needle threads while cooperating with the second fixed knife. The thread trimming device for a sewing machine according to the invention further has means for relaxing the tension of the looper thread during the operation of the first movable knife.

When the needles of the sewing machine stop at the bottom dead point or in the vicinity thereof and the working rod of the looper is in the retracting state, the first movable knife arrests the looper thread drawn from the front end of the working rod (i.e., the working end of the looper) to pull out it, and cut it in cooperation with the first fixed knife to be pressingly held between the knives. Then, when the needles of the sewing machine stop at the top dead point or in the vicinity thereof and the working rod of the looper is in the state that it passes through loops formed by the needle threads, the second movable knife enters the loops and collectively arrests the needle threads to pull them out, and cut them in cooperation with the second fixed knife.

The above and further objects and features of the invention will more fully be apparent from the following detailed description with accompanying drawings.

DESCRIPTION OF THE PREFERRED EMBODIMENTS

The invention will be described with reference to the drawings illustrating its embodiments.

Figure 2:
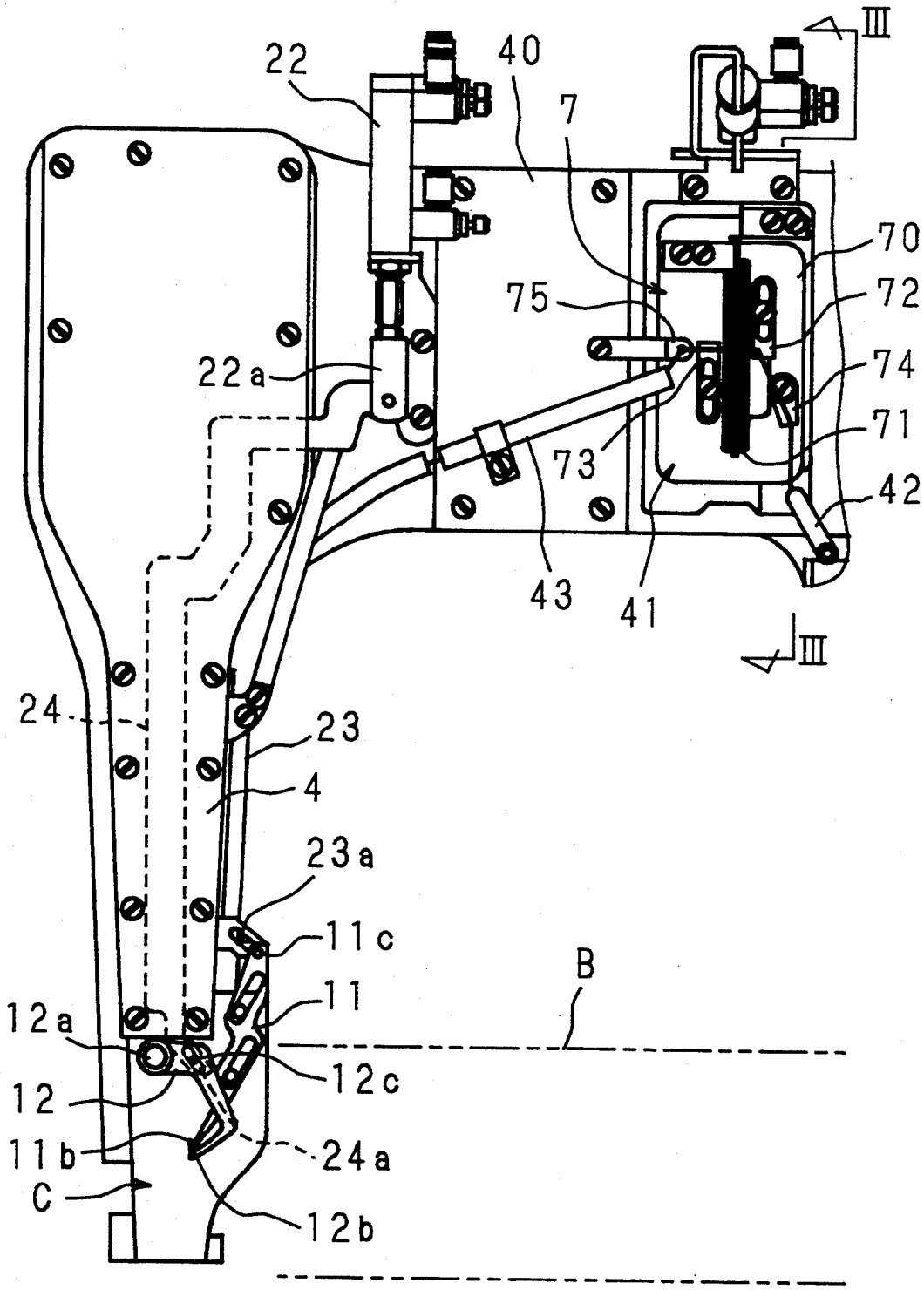
FIG. 2 is a plan view of a bed used in a multi-needle covering chainstich sewing machine having a thread trimming device according to the invention.
Figure 3:
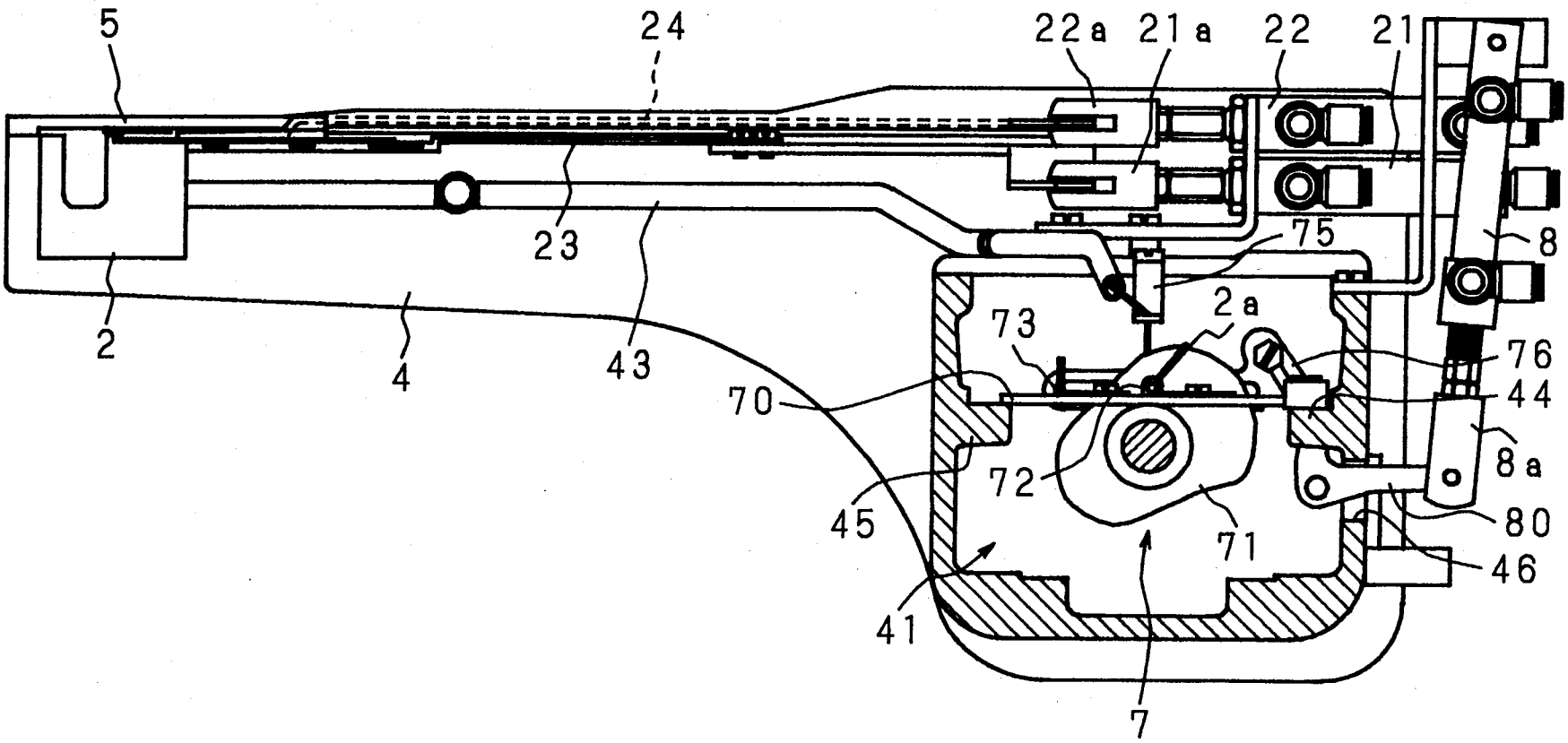
FIG. 3 is a side elevation view taken along the line III—III of FIG. 2.

FIG. 2 is a plan view of a bed used in a multi-needle covering chainstich sewing machine having a thread trimming device according to the invention (hereinafter, referred to as "the present device"), and FIG. 3 is a side elevation view taken along the line III—III of FIG. 2.

As illustrated in the figures, the present device is employed in a multi-needle covering chainstich sewing machine with a cylinder bed 4 of a small diameter. The bed 4 projects forward from a base 40 which elongates in parallel with and behind the machine body B (indicated by two-dot chain lines in FIG. 2), so that the cylinder axis of the bed 4 is orthogonal to the axis of the base 40. At the front end of the bed 4 which is positioned directly under the machine body B, is disposed a stitching portion C the upper face of which is covered by a throat plate 5, and which is provided in its internal space with a looper 2 and a mechanism for feeding a material fabric. For the sake of simplifying the illustration, in FIG. 2, the looper 2 and the feeding mechanism are not shown, and, in FIG. 3, the looper 2 is schematically shown as a box and the feeding mechanism is not shown.

Figure 4:
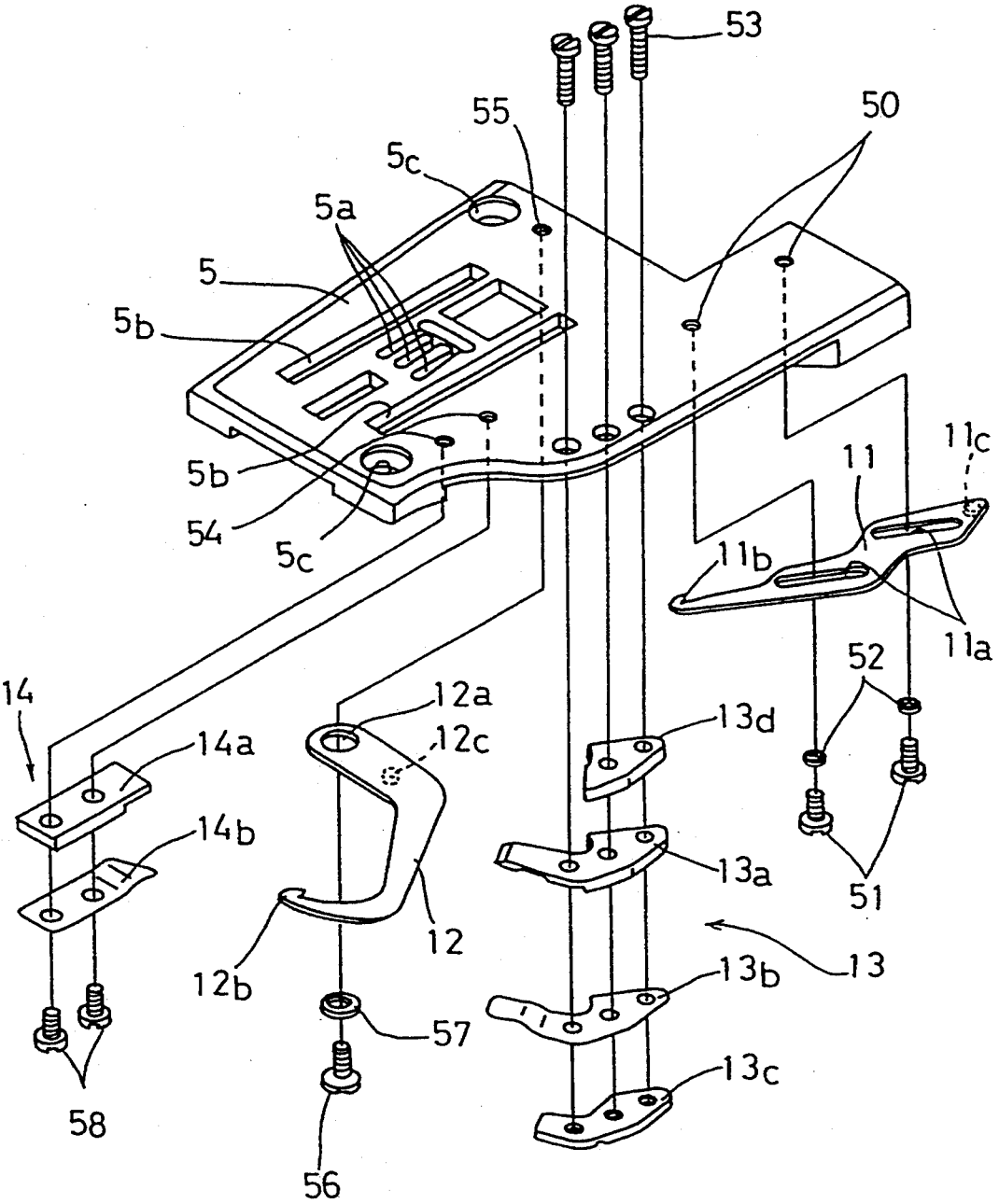
FIG. 4 is an exploded perspective view illustrating the manner of mounting knives for cutting needle threads and a looper thread.

The present device has in the stitching portion C first and second movable knives 11 and 12, and fixed knives 13 and 14 (see FIG. 4) which respectively pair with the first and second knives 11 and 12. These knives are mounted to the lower face of the throat plate 5 covering the upper face of the stitching portion C. FIG. 4 is an exploded perspective view illustrating the manner of mounting the knives to the throat plate 5.

As shown in the figure, the throat plate 5 is a flat plate which has a plan shape corresponding to that of the front end of the bed 4. In the center portion of the throat plate 5, needle drop points 5*a* the number of which corresponds to that of needles 1 provided to the machine body B are arranged in one direction. A pair of slits 5*b* which elongate in a direction orthogonal to the arrangement direction of the needle drop points 5*a* are formed at the both sides of the needle drop points 5*a*. Two bolt holes 5*c* also are formed in the periphery of the throat plate 5. As shown in FIG. 2, the throat plate 5 is positioned so that the arrangement direction of the needle drop points 5*a* is orthogonal to the cylinder axis of the bed 4, and fixed to the bed 4 by fastening fixing bolts (not shown) which are respectively inserted into the bolt holes 5*c*.

The slits 5*b* function to expose feed dogs 6 (see FIG. 6) of the feeding mechanism incorporated in the bed 4, to the upper face of the throat plate 5. The operation of the feed dogs 6 causes the fabric A (see FIG. 1) on the throat plate 5 to be fed in the longitudinal direction of the slits 5*b*. During this feed, the fabric A is subjected to the sewing operation by the combination of the needles 1 (see FIG. 1) which move vertically above the throat plate 5 to pass through the needle drop points 5*a*, and the looper 2 which is operated in synchronization with the vertical motion of the needles 1, thereby forming seams as shown in FIG. 1.

As shown in FIG. 4, the first movable knife 11 has a thin plate-like supporting portion and a knife portion. The supporting portion consists of guide holes 11*a* which are a pair of slits formed in parallel and separated from each other in the longitudinal direction, and periphery areas surrounding the holes 11*a*. The knife portion elongates from the periphery area surrounding one of the guide holes 11*a* in the direction opposite to the other guide hole 11*a*, and has an engaging claw 11*b* at the end of the elongated portion. An engaging projection 11*c* which has a shape similar to a short round rod is formed at the tail of the periphery area surrounding the other guide hole 11*a*, i.e., at the end opposite to the knife portion.

The second movable knife 12 has a supporting portion, an arm portion, and a knife portion. The supporting portion is constituted by elongating the periphery area surrounding a supporting hole 12*a* which has a circular section, in the radial direction. The arm portion elongates from the end of that elongated portion and in the same plane, while forming a predetermined angle therebetween. The knife portion elongates from the front end of the arm portion in the same plane, so as to constitute an arc of a circle which has the center in common with the supporting hole 12*a*. An engaging claw 12*b* which inwardly projects is formed at the front end of the knife portion. An engaging projection 12*c* which has a shape similar to a short round rod is formed at the middle area of one face of the supporting portion.

The lower side of the throat plate 5 at its rear end (i.e., at the end in the side of the base end of the bed 4) is increased in thickness to form a thick portion which is thicker than the other portion. In the thick portion, a pair of threaded holes 50 are formed to penetrate therethrough, in such a manner that they are separated from each other by an adequate distance in the direction parallel to the longitudinal direction of the slits 5*b* (i.e., the feeding direction of the material fabric A). The first movable knife 11 is mounted by respectively inserting fixing screws 51 into the guide holes 11*a* via washers 52 which function as a spacer and then screwing them into the threaded holes 50.

This mounting structure allows; the first movable knife 11 to slide in the longitudinal direction of the guide holes 11*a* and within the distance range equal to the length of the guide holes 11*a*. Since the guide holes 11*a* are oblique with respect to the line connecting the positions where the fixing screws 51 respectively performing the guiding operation are fixed (i.e., the longitudinal direction of the slits 5*b* of the throat plate 5), this sliding motion causes the engaging claw 11*b* at the front end of the first movable knife 11 to advance toward one end of the slits 5*b* along a linear route oblique with respect to the slits 5*b*, and retract along the same route. This reciprocation is performed in the plane which is separated from the back face of the throat plate 5 by the distance equal to the increased thickness of the thick portion.

The motion route of the first movable knife 11 passes the front end of the working rod 2*b* of the looper 2 under the state that the needles 1 are at the bottom dead point and the looper 2 has escaped from the loops formed by the needle threads 1*a* as shown in FIG. 1(*a*), and, more specifically, passes the looper thread 2*a* pulled out from the front end of the working rod 2*b*. In other words, this motion route is set so that the looper thread 2*a* is engaged with the engaging claw 11*b* of the first movable knife 11 which is in the advance state.

At the middle of the motion route of the first movable knife 11, mounted is the first fixed knife 13 which forms a counterpart to the first movable knife 11. The first fixed knife 13 has a knife piece 13*a* and a spring piece 13*b* which are corresponding to each other in a plan view. As illustrated, the knife piece 13*a* has an edge at one side end, and the spring piece 13*b* has a bent portion which functions as a spring, at the corresponding side end. These pieces and a pressing piece 13*c* are stacked via a spacer piece 13*d* of a given thickness on a periphery portion of the lower face of the throat plate 5 which is at the side of mounting the first movable knife 11. Fixing screws 53 are passed from the upper face of the throat plate 5 through the spacer piece 13*d*, knife piece 13*a* and spring piece 13*b*, and then screwed into respective threaded holes formed on the pressing piece 13*c*, whereby the first fixed knife 13 is fixed as a whole.

The edge at the front end of the thus fixed knife piece 13*a* faces the front end of the working rod 2*b* of the looper 2 under the state that the needles 1 are at the bottom dead point. The lower face of the spacer piece 13*d* is slanted in order to ensure the cutting of the needle threads 1*a* which is done by the combination of the knife piece 13*a* and the first movable knife 11 as described below. Therefore, the engaging claw 11*b* of the first movable knife 11 performs the above-mentioned reciprocating operation while being sandwiched between the knife piece 13*a* and the spring piece 13*b*. During the retracting operation of the engaging claw 11*b*, the looper thread 2*a* engaged therewith is cut at the position contacting with the edge of the knife piece 13*a*. The cut end is pressingly held between the lower face of the engaging claw 11*b* and the spring piece 13*b*.

The throat plate 5 further has a pair of threaded holes 54 formed in front of and along the slit 5*b* which is at the side of mounting the first movable knife 11, and a threaded hole 55 formed behind the other slit 5b. The second movable knife 12 is fixedly mounted by passing a fixing screw 56 through the supporting hole 12a via a washer 57 functioning as a spacer, and screwing it into the threaded hole 55.

This mounting structure allows the second movable knife 12 to swing about the supporting hole 12a using the fixing screw 56 as an axis. During this swing operation, the engaging claw 12b at the front end traverses the space directly under the needle drop points 5a, in the arrangement direction of the needle drop points. As shown in FIG. 1(*c*), the engaging claw 12b and the working rod 2b of the looper 2 enter into the loops formed by the needle threads 1a under the needle drop points 5a, and the needle threads 1a are collectively pulled out by the retracting operation of the engaging claw 12b.

The second fixed knife 14 which is paired with the second movable knife 12 consists of a knife piece 14a having an edge at one side end, and a spring piece 14b having a bent portion which functions as a spring, at the corresponding side end. These pieces are stacked while aligning each other in a plan view, and then fixedly mounted by respectively passing two fixing screws 58 from the under side, and screwing them into the threaded holes 54, in such a manner that the edge of the knife piece 14a is on the arrangement line of the needles 1, i.e., on the motion route of the second movable knife 12, and faces the side of the arrangement of the needles 1.

Namely, the engaging claw 12b of the second movable knife 12 performs the above-mentioned reciprocating operation while being sandwiched between the knife piece 14a and the spring piece 14b. During the retracting operation of the engaging claw 12b, the needle threads 1a is pulled out while being engaged therewith, and then cut at the position contacting with the edge of the knife piece 14a.

The aforesaid operations of the first and second movable knives 11 and 12 are performed in accordance with the reciprocating operation of respective air cylinders 21 and 22 mounted in the rear portion of the bed 4, as shown in FIGS. 2 and 3. The air cylinders 21 and 22 have an output end directed toward the front end of the bed 4, and are fixed so as to be parallel with the cylinder axis of the bed 4. Their output ends 21a and 22a are engaged with the base ends of separate connecting plates 23 and 24, respectively.

As shown in FIG. 2, the connecting plate 23 is a narrow flat plate which elongates from the output end 21a of the air cylinder 21 toward the bed 4 and runs forward along the side of the bed 4. At the front end of the connecting plate 23, formed is a slit 23a which is oblique with respect to the cylinder axis of the bed 4 and into which the engaging projection 11c formed on the rear end of the first movable knife 11 is fitted.

The other connecting plate 24 has a structure wherein a base end portion which bends toward the output end 22a of the air cylinder 22, and a front end portion which is slanted by an appropriate angle with respect to the cylinder axis are connected to a narrow flat; plate which linearly elongates in such a manner that its front end is directed to the center portion of the width direction of the bed 4 in the vicinity of the upper face thereof, as shown in FIG. 2. At the front end of the connecting plate 24, formed is a slit 24a which is slanted along the slant of the front end and into which the engaging projection 12c formed on the second movable knife 12 is fitted.

FIG. 2 shows the state in which both the air cylinders 21 and 22 are in the retracting position. When the air cylinder 21 advances from this state to perform one reciprocating motion, the portion where the engaging projection 11c is formed is pushed forward via the connecting plate 23 in accordance with the advance motion, and the first movable knife 11 is caused by the guiding action of the guide holes 11a and fixing screws 51 to advance toward the center portion of the bed 4 along the line oblique with respect to the cylinder axis of the bed 4. In accordance with the following retracting motion of the air cylinder 21, the first movable knife 11 moves reversely along that line to retract.

When the other air cylinder 22 performs one reciprocating motion, the portion where the engaging projection 12c is formed is pushed forward via the connecting plate 24 in accordance with the advance motion, and the second movable knife 12 is caused to swing on an axis which is constituted by the fixing screw 56 inserted into the supporting hole 12a, so that the engaging claw 12b at the front end performs the above-mentioned advance motion. The engaging claw 12b moves reversely to retract in accordance with the following retracting motion of the air cylinder 22.

At the side of the fixing location of the air cylinders 21 and 22 thus operating and in a cavity 41 of the base 40, mounted is a thread take-up cam device 7 which has a structure shown in FIG. 3. The thread take-up cam device 7 is a known device for adjusting the length of the looper thread 2a to be pulled out in accordance with the above-mentioned operation of the looper 2, and consists of a pedestal 70 extending substantially horizontally in the cavity 41, and a thread take-up cam 71 which has a plan shape as shown in FIG. 2 and is rotated about an axis under the pedestal 70. A pair of cam eyelets 72 and 73 are respectively fixed in front of and behind the thread take-up cam 71 which projects above the pedestal 70. As shown in FIG. 3, the cam eyelet 72 has one threading hole which is positioned above the axis of the thread take-up cam 71, and the cam eyelet 73 has a slit which elongates along the upper face of the pedestal 70.

Eyelet pipes 42 and 43 open on the opposing side walls of the cavity 41 respectively. The eyelet pipe 42, one portion of which is shown in FIG. 2, is elongated toward the machine body B. The other eyelet pipe 43 is elongated along the side of the bed 4 to the mounting position of the looper 2 under the throat plate 5. An eyelet 74 is fixed to the pedestal 70 of the thread take-up cam device 7 in such a manner that the eyelet 74 opposes the open end of the eyelet pipe 42 from the machine body B. An eyelet 75 which has a base fixed to the upper face of the base 40 and an front end hanging in the cavity 41 is disposed so as to oppose the open end of the eyelet pipe 43 directed to the bed 4.

The looper thread 2a is supplied from the machine body B via the eyelet pipe 42 to the thread take-up cam device 7. At first, the looper thread 2a is passed through the eyelet 74 and the cam eyelet 72 in this sequence, and laid on the upper edge of the thread take-up cam 71 which projects above the pedestal 70. Then, the looper thread 2a is passed through the cam eyelet 73 and the eyelet 75 in this sequence, and supplied via the eyelet pipe 43 to the looper 2. The thread take-up cam 71 of the thread take-up cam device 7 rotates in synchronization with the rotation of the looper 2. The looper thread 2a laid on the upper edge is strained when the convex portion passes with the rotation of the thread take-up cam 71, and is relaxed when the concave portion passes, resulting in that the looper thread 2a is pulled out in a proper length in accordance with the operation of the looper 2.

As shown in FIG. 3, the pedestal 70 of the thread take-up cam device 7 thus functioning extends across projections 44 and 45 which oppositely project inside the cavity 41, but is not fixed to these projections 44 and 45. More specifically, the pedestal 70 is supported by the projection 44 so that it is swingable about a horizontal axis which elongates along one peripheral edge, and the other projection 45 functions only as a stopper for restricting the swing motion. Namely, the swing motion of the pedestal 70 can be performed only in the direction along which the portion at the side of the projection 45 moves upward. An air cylinder 8 which is a driving source for the swing motion is fixed to time rear side of the base 40 so that its output end 8a advances downward.

In the cavity 41, a swing arm 80 having an L-like shape in a plan view is supported at its bent portion so that the arm 80 is swingable in a substantially vertical plane. The supporting point is slightly lower than the projection 44. One end of the swing arm 80 passes through a through hole 46 formed in the back wall of the base 40, to protrude outside the cavity 41. The protruding end is engaged with the output end 8a of the air cylinder 8. The other end of the swing arm 80 protrudes over the upper face of the pedestal 70 and is engaged with a bracket 76 which stands at the corresponding position of the upper face.

Figure 5:
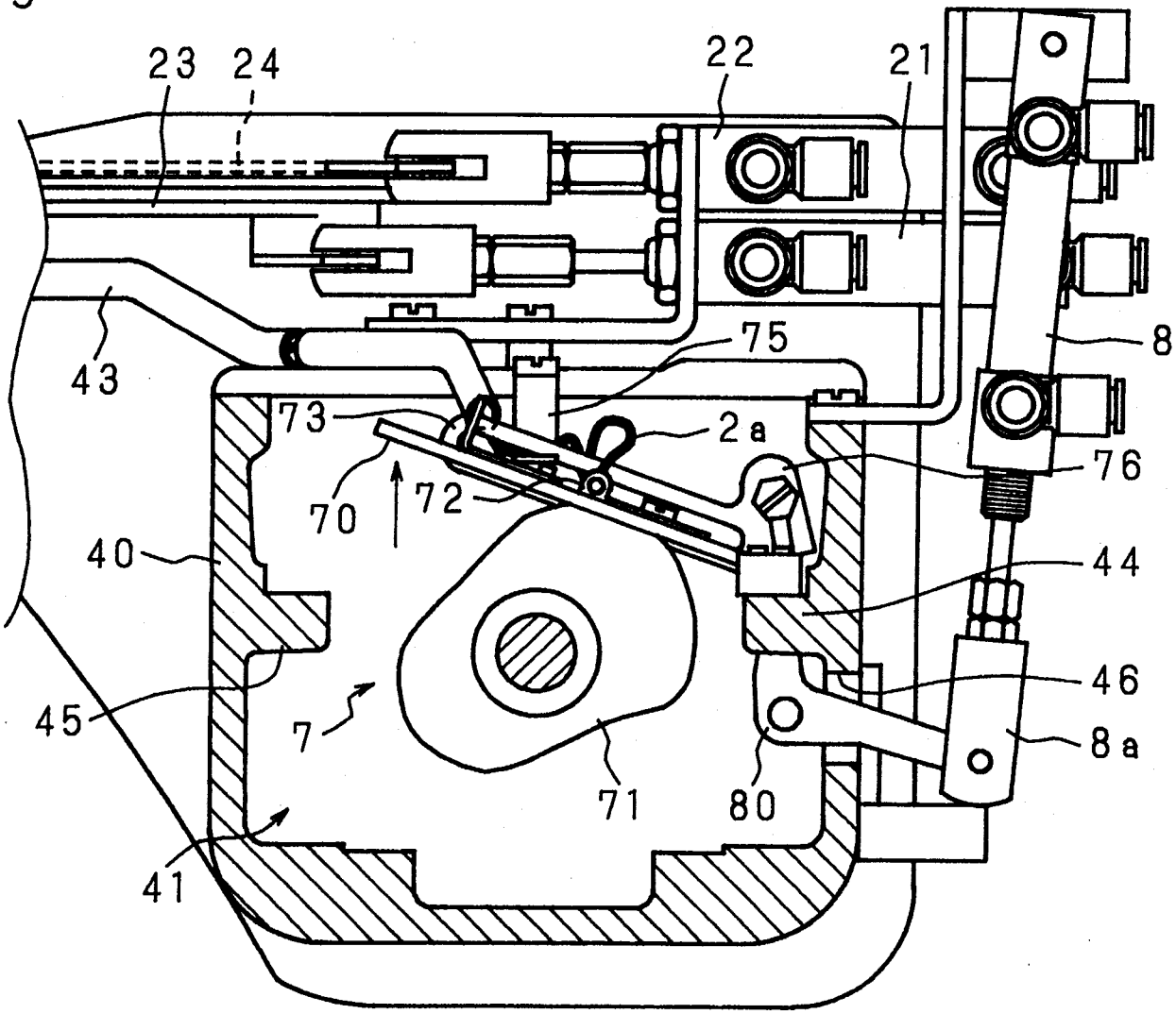
FIG. 5 is a sectional view illustrating the operation state of a thread tension releasing mechanism for a looper thread.

In the configuration described above, when the air cylinder 8 advances, the swing arm 80 is pushed downward at the end engaged with the output end 8a, to swing. This swing motion causes the end engaged with the bracket 76 to perform the backward arcuate motion, whereby the pedestal 70 is pulled backward at the position of the bracket 76 to swing in the direction along which the portion at the side of the projection 45 is lifted. As a result, as shown in FIG. 5, the degree of projection of the thread take-up cam 71 above the pedestal 70 is reduced, so that, irrespective of the rotational position of the thread take-up cam 71, the looper thread 2a is relaxed in tension to become loose. In the range of this looseness, the looper thread 2a can be freely pulled from the upper stream side, i.e., the side of the looper 2.

Figure 11:
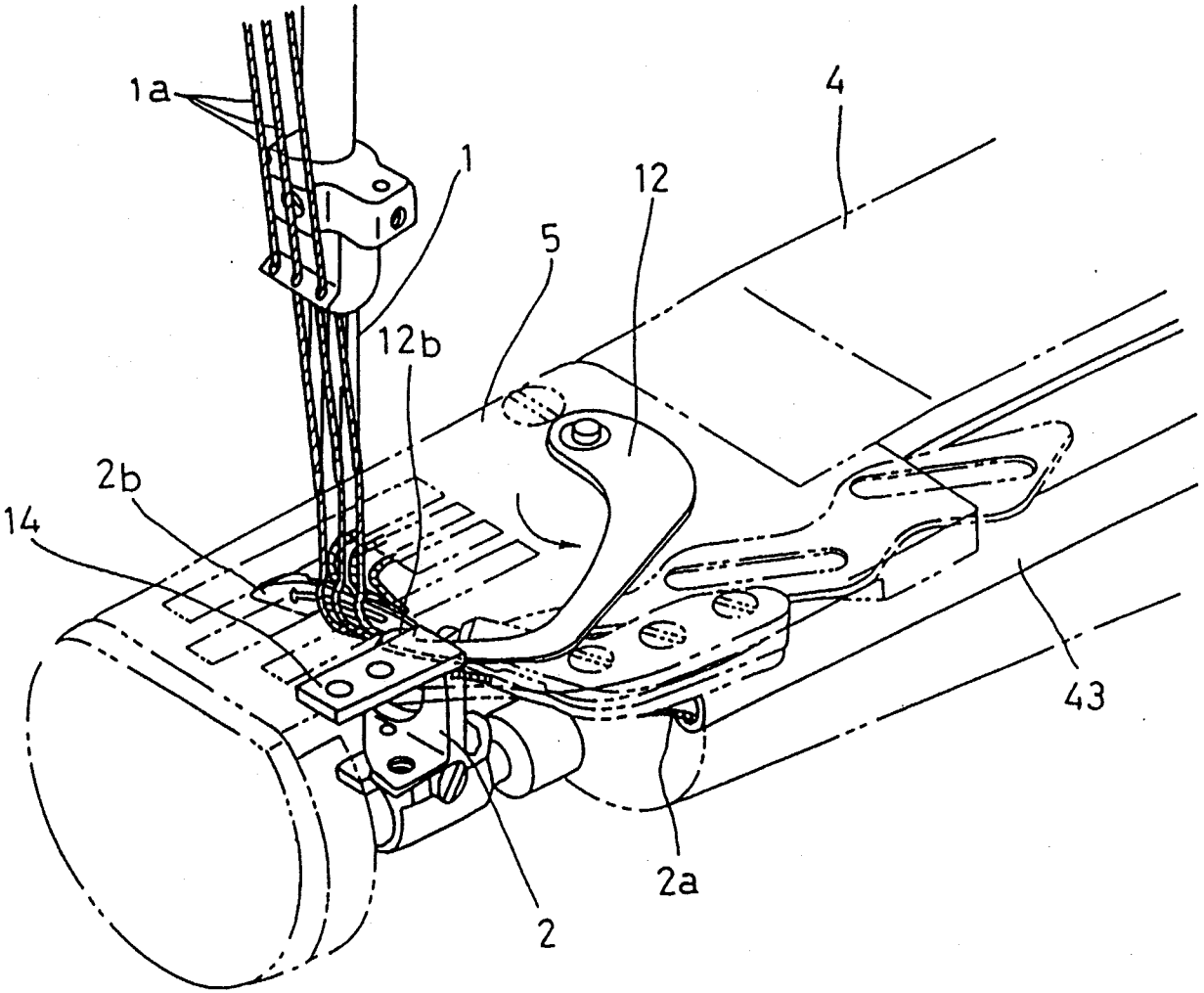
Figure 12:
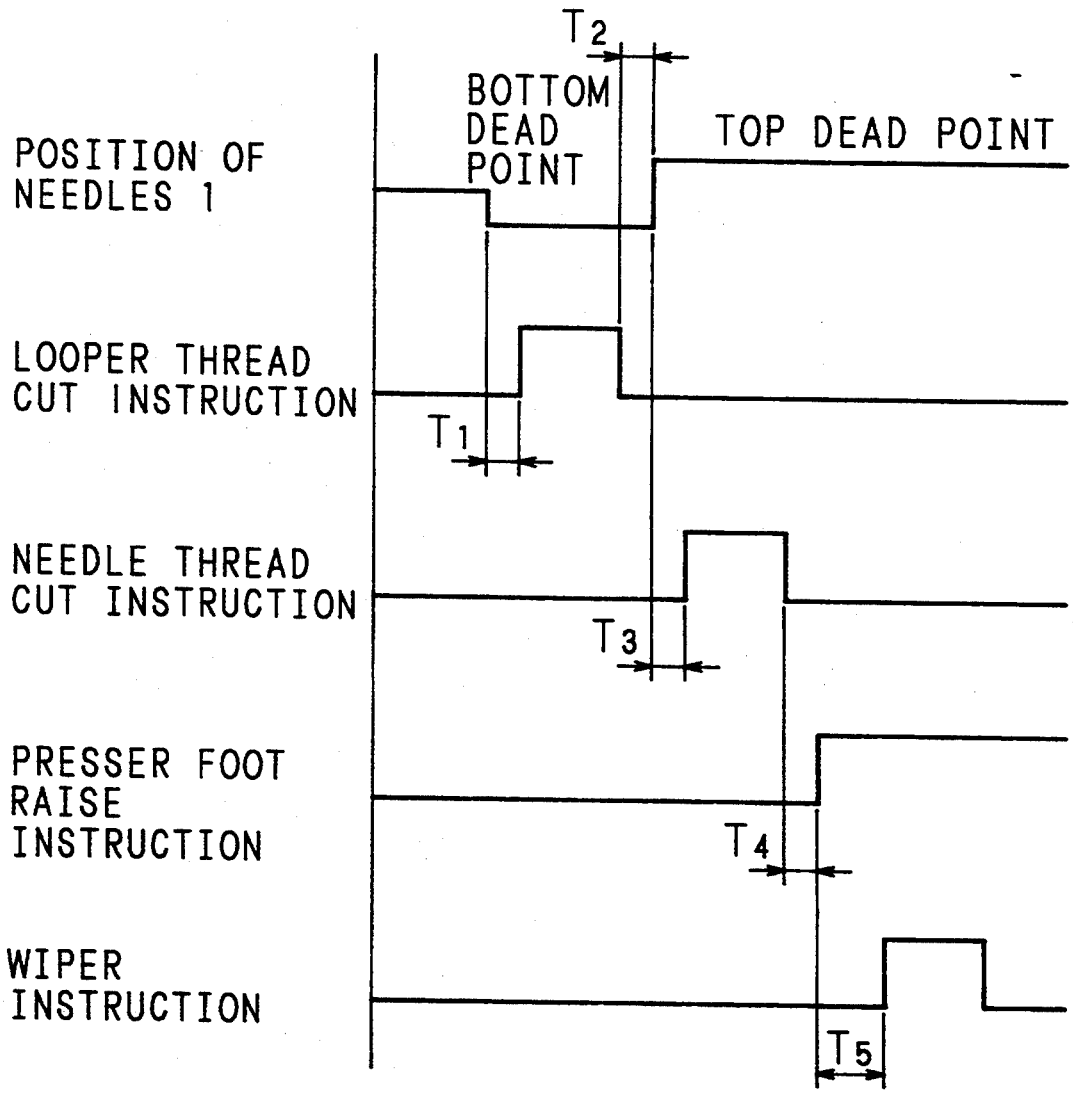
FIGS. 12 and 13 are timing charts illustrating the operation timing of various portions of the thread trimming device according to the invention.
Figure 13:
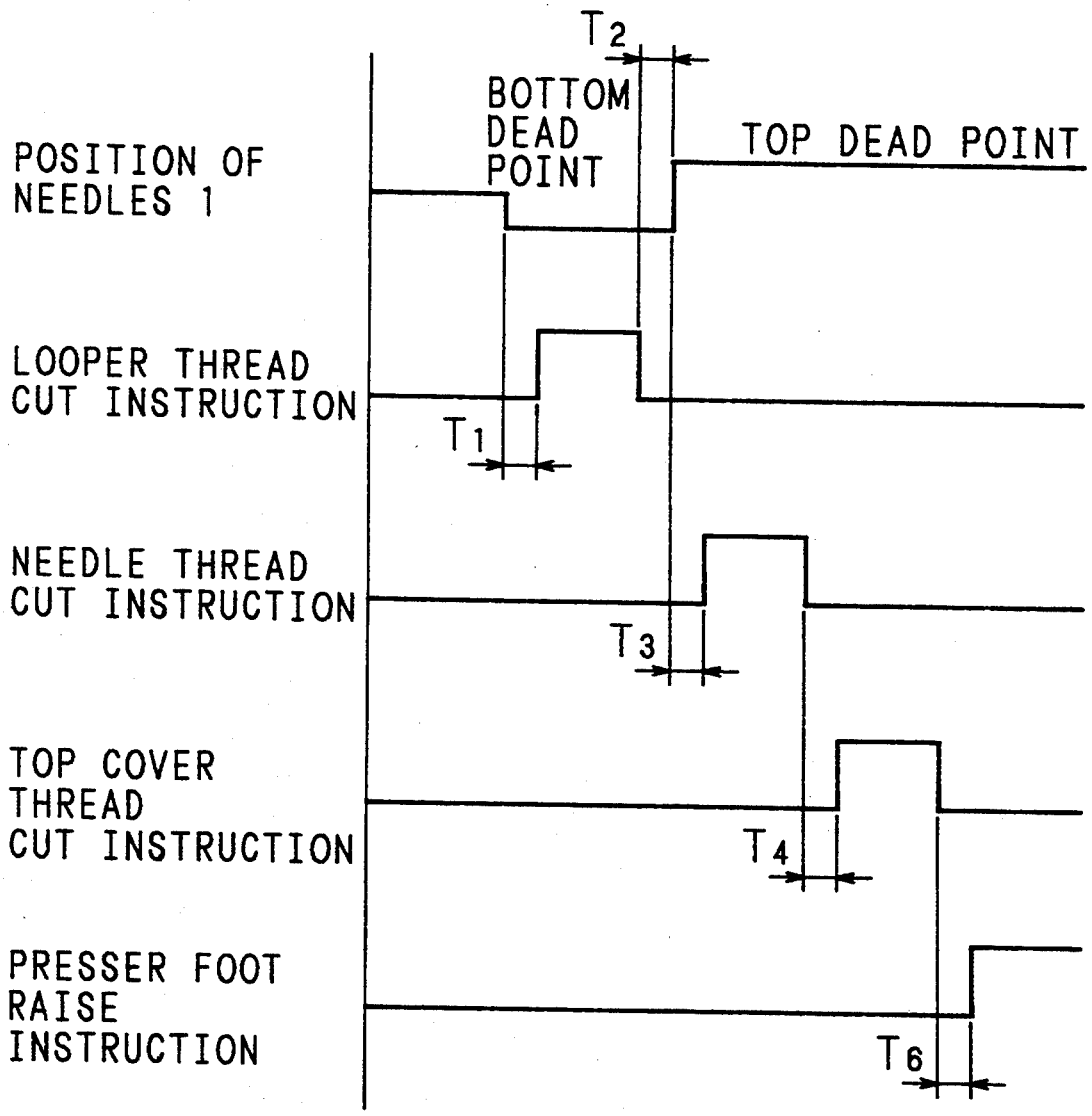

FIGS. 6 to 11 are views illustrating the operation of cutting threads in the thus configured present device, and FIGS. 12 and 13 are timing charts illustrating the operation timing of the various portions. FIG. 12 illustrates the operation timing in the case that the top cover seaming is not performed on the upper face of the material fabric A by the top cover thread looper 3 shown in FIG. 1, and FIG. 13 the operation timing in the case that the top cover seaming is performed. The operation will now be described in conjunction with the timing chart illustrated in FIG. 12.

After the sewing operation is ended, the instruction to cut threads is given, for example, by operating a pedal (not shown). At first, when the pedal is released from being pressed to stop the operation of the sewing machine, a signal indicative that the needles I are to be compulsorily moved from the current position to the vicinity of the bottom dead point is produced as shown in FIG. 12. After a preset waiting period $T_1$ has elapsed, a looper thread cut instruction is issued.

Figure 6:
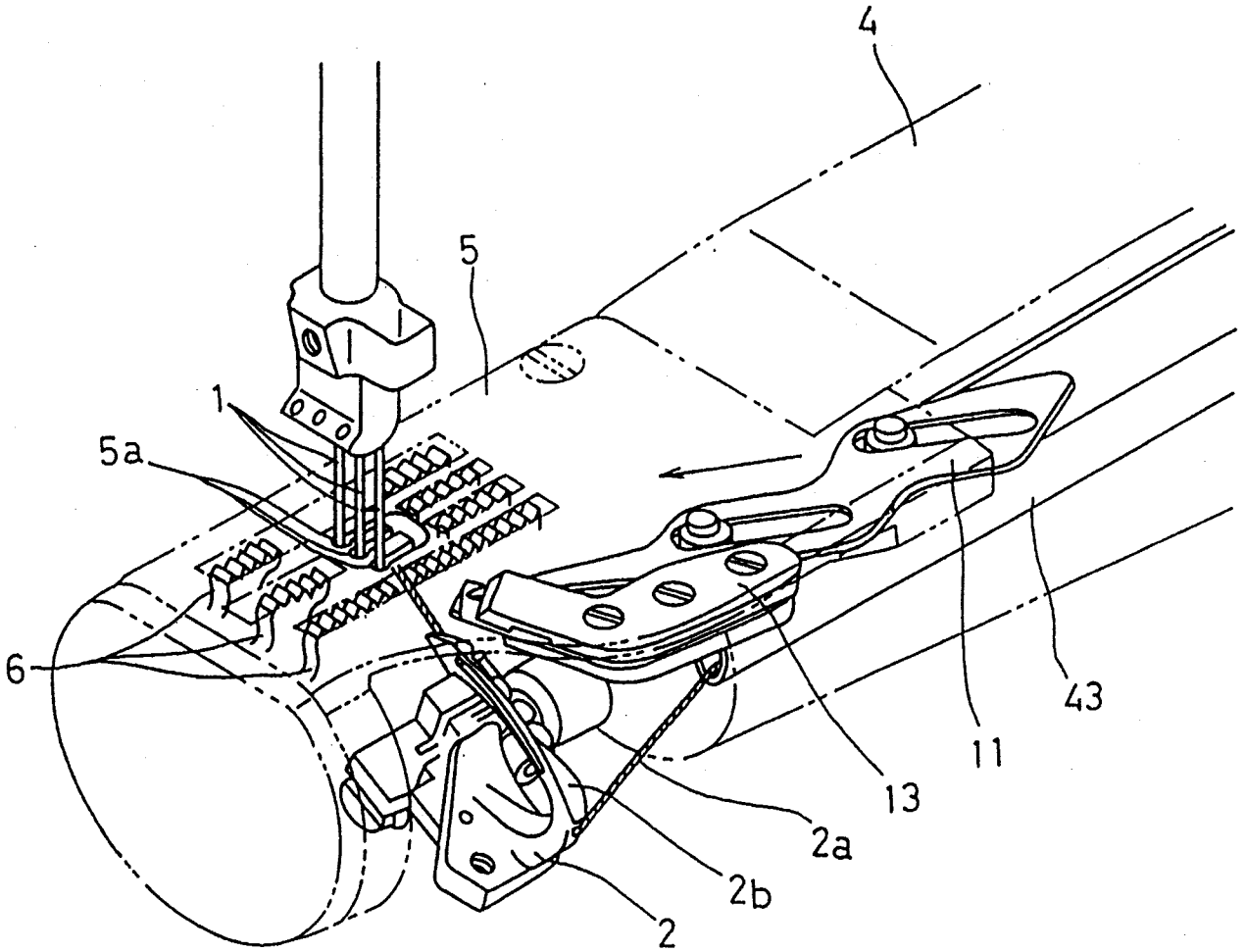
FIGS. 6, 7 and 8 are views illustrating the operation of cutting a looper thread in the thread trimming device according to the invention.

This causes the needles 1 to be inserted into the respective needle drop points 5a of the throat plate 5 as shown in FIG. 6. As described in conjunction with FIG. 1, the working rod 2b of the looper 2 is in the state that the working rod 2a has escaped from the loops formed by the needle threads 1a. At this time, the looper thread 2a pulled out from the front end of the working rod 2b opposes the front ends of the first movable knife 11 and the first fixed knife 13 which are configured under the throat plate 5 as described above.

The waiting period $T_1$ is preset in view of the period required for the needles 1 to arrive in the vicinity of the bottom dead point and also the period required for confirming their stop in the vicinity of the bottom dead point. In accordance with the looper thread cut instruction issued after this waiting period has elapsed, the first movable knife 11 is operated to cut the looper thread 2a. More specifically, the looper thread cut instruction is a signal instructing the air cylinder 21 to advance and also the air cylinder 8, which swings the pedestal 70 of the thread take-up cam device 7, to advance.

Figure 7:
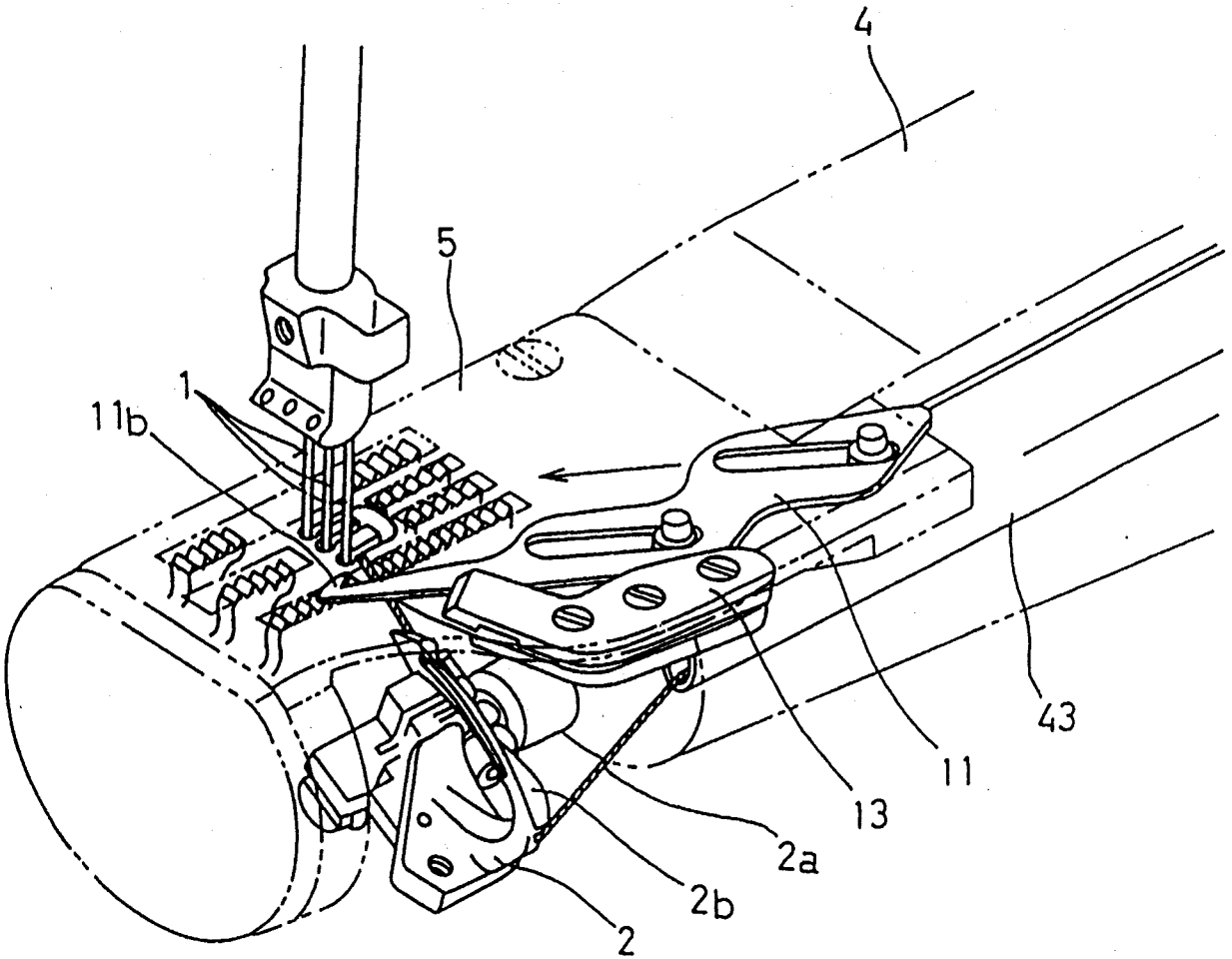

Namely, in accordance with the advancement of the air cylinder 21 in response to the looper thread cut instruction, the first movable knife 11 advances toward the looper thread 2a in the above-mentioned state, and as shown in FIG. 7 stops when the engaging claw 11b at its front end passes the looper thread 2a (i.e., at the position shown in FIG. 7). In accordance with the advancement of the air cylinder 8 during this process, the pedestal 70 of the thread take-up cam device 7 is inclined as shown in FIG. 5, thereby allowing the looper thread 2a to be pulled out.

Figure 8:
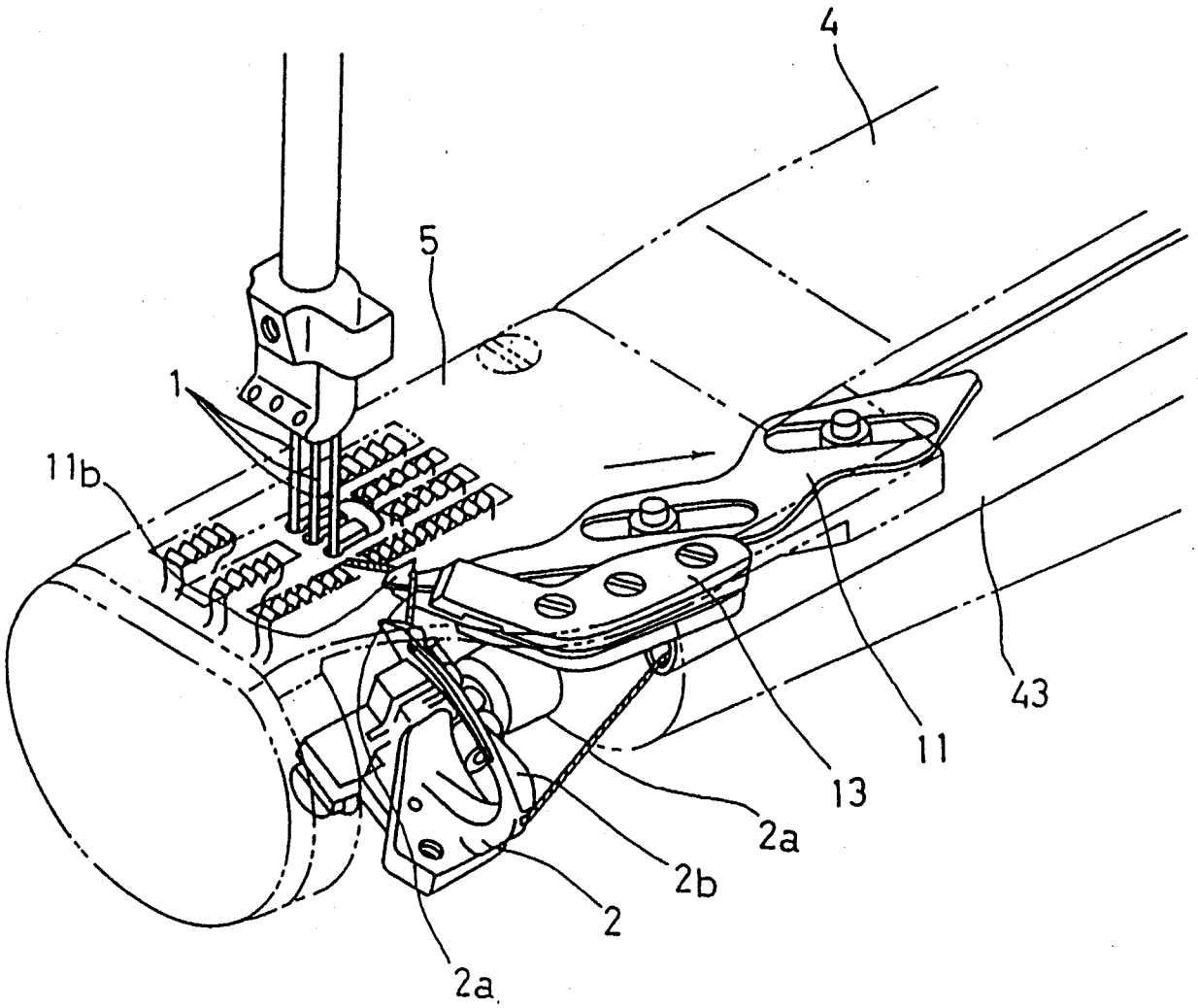

Then, in accordance with the retraction of the air cylinder 21 due to the stop of the looper thread cut instruction, the first movable knife 11 retracts. As shown in FIG. 8, the engaging claw 11b at its front end arrests the looper thread 2a positioning in the retraction route, and draws the looper thread 2a into the contact point between the first movable knife 11 and the edge of the first fixed knife 13, whereby the looper thread 2a is cut at this point. As described above, the cut end of the looper thread 2a is pressingly held between the spring piece 13b of the first fixed knife 13 and the upper face of the first movable knife 11.

Figure 1A:
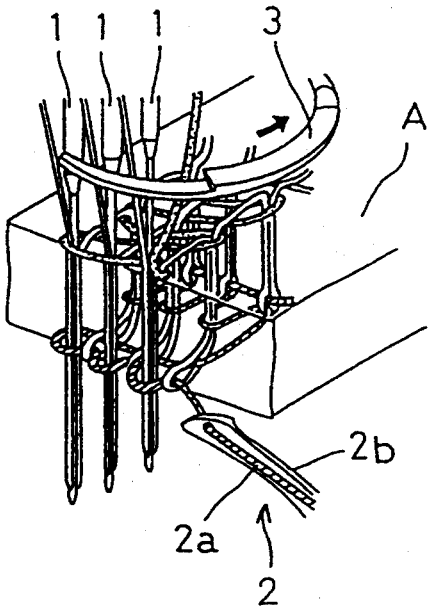
FIG. 1 is a view illustrating sewing steps performed in a multi-needle covering chainstich sewing machine.
Figure 1B:
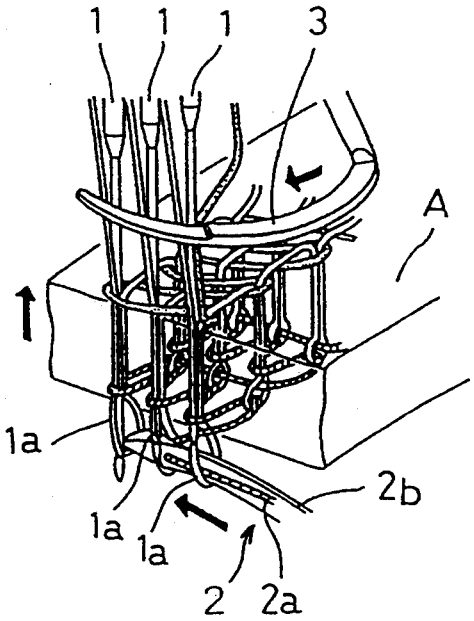
Figure 1C:
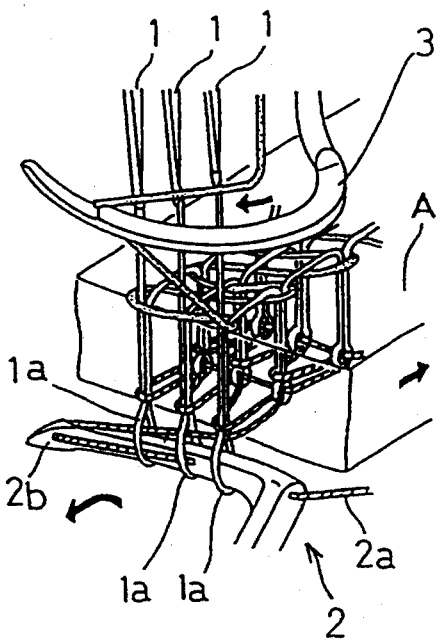
Figure 1D:
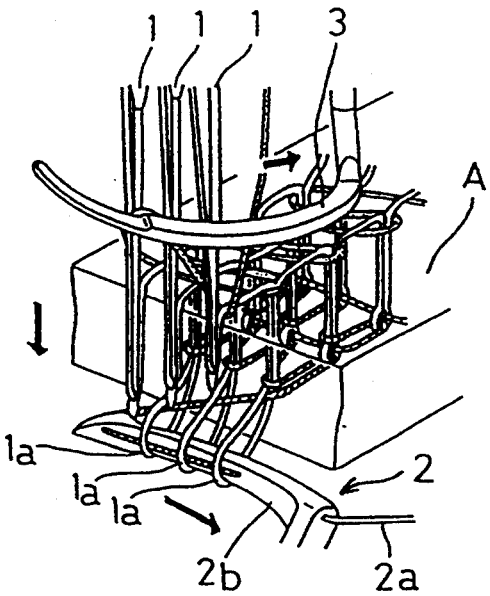

As seen from above, in the present device, the looper thread 2a is subjected to the cutting operation in the state that the needles i are in the vicinity of the bottom dead point and that the working rod 2b of the looper 2 has retracted from the loops of the needle threads 1a. In this state, as shown in FIG. 1(a), the looper thread 2a stays apart from the loops of the needle threads 1a. This allows the looper thread 2a to be surely arrested by the engaging claw 11b and then succeedingly cut, and the cut looper thread 2a to be separately held. Furthermore, the looper thread 2a, which was strained in the vicinity of the bottom dead point during the sewing operation, is relaxed by tilting the pedestal 70 of the thread take-up cam device 7 before the engaging claw 11b arrests it, thereby further ensuring the operation of cutting it.

When a preset waiting period $T_2$ has elapsed after the stop of the aforesaid looper thread cut instruction, a signal indicative that the needles 1 are to be compulsorily moved to the vicinity of the top dead point is produced, and, after a preset waiting period $T_3$ has further elapsed, a needle thread cut instruction is issued.

Figure 9:
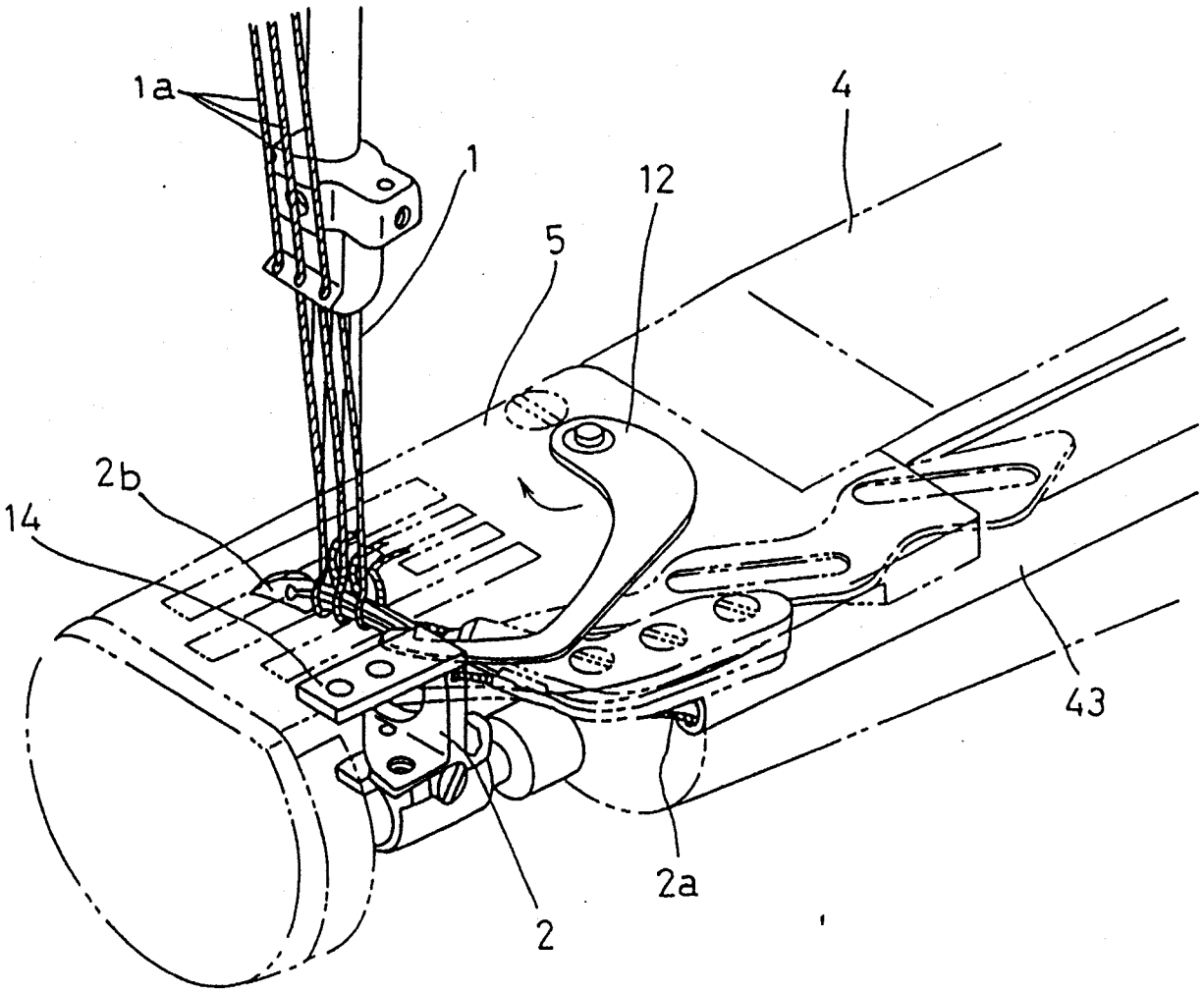
FIGS. 9, 10 and 11 are views illustrating the operation of cutting needle threads in the thread trimming device according to the invention.
Figure 10:
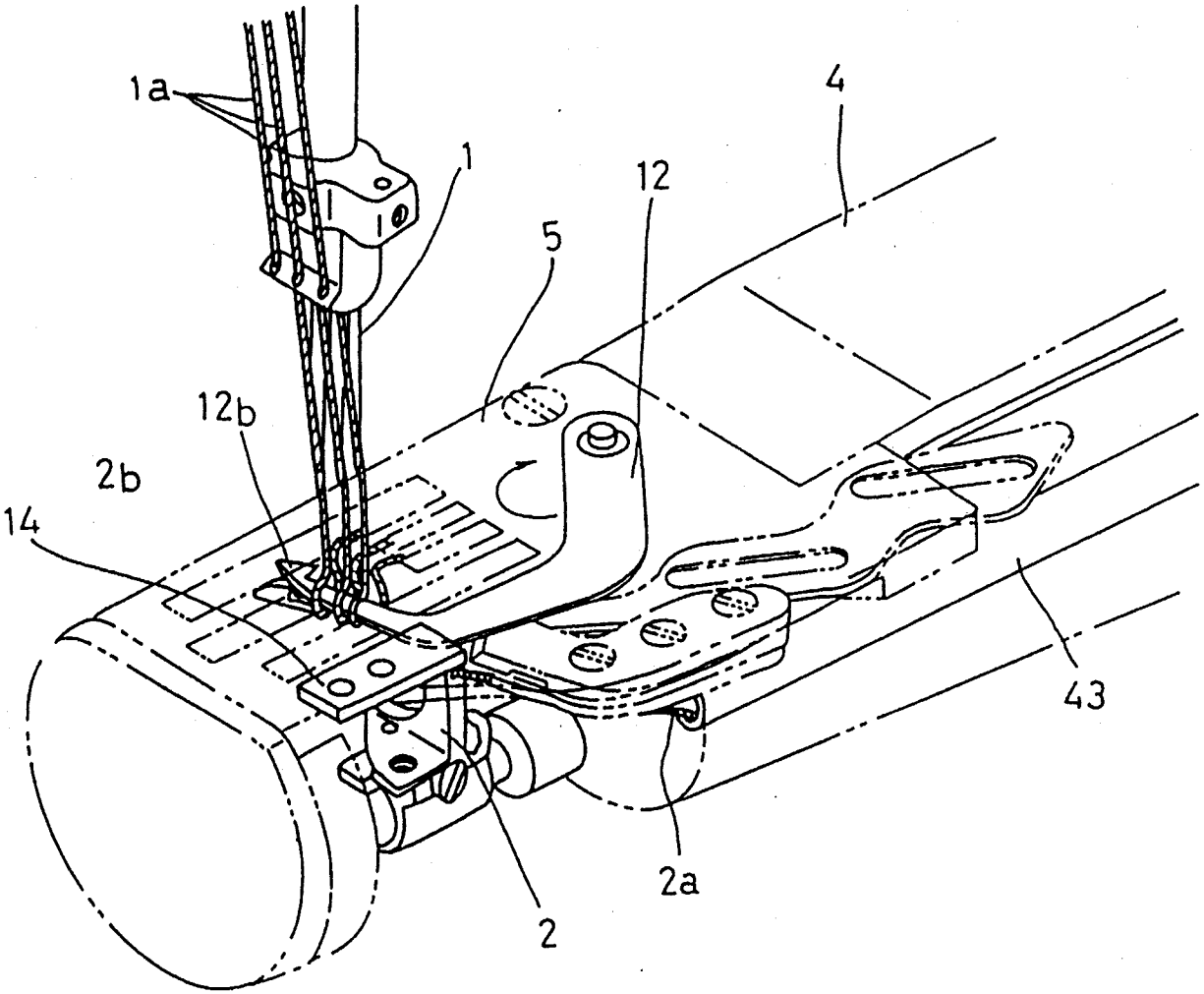

The waiting period $T_2$ is preset in view of the period required for the air cylinder 21 to retract after the stop of the looper thread cut instruction (i.e., the period required for surely cutting the looper thread 2a by the retraction of the first movable knife 11), and also the period required for confirming the end of the retracting operation. When the looper thread 2a is surely cut, a move instruction is issued. In accordance with this move instruction, as shown in FIG. 9, the needles 1 are moved upward, and stopped when they reach the vicinity of the top dead point. When the waiting period $T_2$ is too short or it is not preset, the working rod 2b of the looper 2 which moves with the upward motion of the needles 1 collides with the first movable knife 11 which retracts across this motion route, whereby one or both of them may be damaged. Therefore, it is important to adequately preset the waiting period $T_2$.

The waiting period $T_3$ is preset in view of the period required for the needles 1 to moves from the bottom dead point to the top dead point, and also the period required for confirming their stop in the vicinity of the top dead point. In accordance with the needle thread cut instruction issued after this waiting period has elapsed, the second movable knife 12 is operated to cut the needle threads 1a. More specifically, the needle thread cut instruction is a signal instructing the air cylinder 22, which drives the second movable knife 12, to advance in a predetermined distance.

When the needles 1 are at the top dead point, the working rod 2b of the looper 2 under the throat plate 5 is in the state that the working rod 2b has passed through the loops formed by the needle threads 1a, as shown in FIG. 1(*c*). The advance operation of the air cylinder 22 according to the needle thread cut instruction issued at this time causes the second movable knife 12 to swing about the supporting hole 12a. The arcuate knife portion of the movable knife 12 is inserted from the side of the working rod 2b into the loops of the needle threads 1a which are in the above-mentioned state, and is stopped when the engaging claw 12b at the front end passes the innermost needle thread 1a (i.e., at the position shown in FIG. 10).

In accordance with the retraction of the air cylinder 22 due to the stop of the needle thread cut instruction, the second movable knife 12 begins to swing in the reverse direction, so that the engaging claw 12b at the front end arrests in sequence the needle threads 1a which are arranged in the retraction route, as shown in FIG. 11. The needle threads 1a are drawn into the contact point between the second movable knife 12 and the edge of the second fixed knife 14, whereby the needle threads 1a are cut at this point. The cut needle threads 1a are not held between the second movable knife 12 and the second fixed knife 14, and are left as they are.

As described above, in the present device, when the needles 1 are in the vicinity of the top dead point and the working rod 2b of the looper 2 is in the state that it is inserted into the loops of the needle threads 1a, only the needle threads 1a which can be surely arrested by the second movable knife 12 swinging in the plane of the throat plate 5 are cut.

When a preset waiting period $T_4$ has elapsed after the stop of the needle thread cut instruction, a signal indicative that a presser foot for the material fabric A is to be moved upward (presser foot raise instruction) is produced. When a further preset waiting period $T_5$ has elapsed, an instruction to operate a wiper for pushing upward to the upper face of the throat plate 5 the portion of the needle threads 1a which remain to be held by the needles 1 is issued, thereby completing the series of thread cutting operations.

The waiting period $T_4$ is preset in view of the period required for the air cylinder 22 to retract after the stop of the needle thread cut instruction (i.e., the period required for the needle threads 1a to be surely cut by the reverse swing of the second movable knife 12), and also the period required for confirming the stop of the retracting operation. The waiting period $T_5$ is preset in view of the period required for the fabric A to be removed from the bed 4 after the presser foot is raised. In order to surely and safely remove the fabric A, these periods must be adequately set.

The removal of the fabric A is performed during the period elongating from the raise of the presser foot and to the operation of the wiper, and causes the cut ends of the needle threads 1a and looper thread 2a remaining in the side of the material fabric A to be pulled out over the throat plate 5, and also one portion of the cut ends of the needle threads 1a held in the side of the needles 1 to be pulled out. However, since the cut end of the looper thread 2a remaining in the side of the looper 2 is pressingly held between the first movable knife 11 and the spring piece 13b, it is prevented from slipping off the working rod 2b of the looper 2 and surely remains to be under the throat plate 5. This eliminates the necessities of checking the state of holding the looper thread 2a and setting again the looper thread 2a to the working rod 2b, so that it is possible to quickly start the next sewing operation, thereby improving the sewing efficiency.

The timing chart of FIG. 13 illustrating a case that the top cover seaming is conducted on the upper face of the material fabric A will be supplementally described. Also in this case, the operations before the cutting of the looper thread 2a and needle threads 1a are conducted in the same manner as described above, and a top cover thread cut instruction is additionally issued before the issuance of the presser foot raise instruction.

The top cover thread cut instruction is issued when the waiting period $T_4$ has elapsed after the stop of the needle thread cut instruction. In accordance with the top cover thread cut instruction, a top cover thread cutter (which is not illustrated in the figures) is operated to cut the top cover thread which is reeled as shown in FIG. 1 by the operation of the top cover thread looper 3. Since this cutting motion is performed in the space above the throat plate 5 and consequently does not interfere with the above-described operation of cutting the needle threads 1a, the operation of cutting the top cover thread may be performed simultaneously with that of cutting the needle threads 1a.

When a preset waiting period $T_6$ has elapsed after the stop of the to cover thread cut instruction, the signal indicative that the presser foot for the material fabric A is to be moved upward (presser foot raise instruction) is produced, thereby completing the series of thread cutting operations. The waiting period $T_6$ is preset in view of the period required for the top cover thread cutter to retract after the stop of the top cover thread cut instruction, and also the period required for confirming the end of the operation.

In the embodiment described above, the air cylinders 21 and 22 are used as means for driving the first and second movable knives 11 and 12. Alternatively, other driving means such as solenoids may be used in place of the air cylinders. It is obvious to those skilled in the art that the applicable range of the invention is not restricted within multi-needle covering chainstich sewing machines with the cylinder bed 4 of the configuration described above, but the invention can be applied to multi-needle covering chainstich sewing machines with a cylinder bed of another configuration such as that having a cylinder axis parallel to or slanted with respect to the machine body B.

In the embodiment described above, the first movable knife 11 and the first fixed knife 13 are mounted to the lower face of the throat plate 5. These knives 11 and 13 may be mounted to other members, and the mounting position of these knives 11 and 13 is not restricted to the lower face of the throat plate 5.

According to the invention, as described above, the looper thread is cut when the needles are stopped in the vicinity of the bottom dead point, and then the needle threads are collectively cut when the needles are stopped in the vicinity of the top dead point. Therefore, in these thread cutting operations, the process of arresting these threads and the succeeding process of cutting the arrested threads can be surely conducted. After these threads have been cut, moreover, only the looper thread remains to be surely held. This prevents the looper thread from slipping off the looper when the fabric is removed, so that it is not necessary to set again the looper thread to the looper, thereby greatly improving the sewing efficiency. Since the thread cutting operations are performed by knives moving under the throat plate and in the plane thereof, the present device can be applied to a sewing machine with a cylinder bed of a small diameter.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A method of cutting threads in a sewing machine of the type having a cylinder bed with a throat plate thereon over which the material being sewn passes, the throat plate having at least one opening through which a needle carrying a thread passes after passing through the material comprising the steps of:

providing a plurality of needles each carrying a thread, vertically reciprocating said needles from a top dead point through said material and said throat plate opening to a bottom dead point, providing a looper carrying a looper thread under said throat plate, reciprocating said looper and looper thread to intertwist with said plurality of needle threads when said needle threads are carried by said needles to a position below said throat plate, providing a first and a second cutter below said throat plate, cutting said looper thread with said first cutter when the needles are below said throat plate, and cutting all of said needle threads with said second cutter when said needles are above said throat plate.

2. A method according to claim 1, wherein said looper thread and said needle threads are cut inside said bed.

3. The method of claim 1 wherein said first cutter cuts the looper thread when the plurality of needles are substantially at the location of the bottom dead point of vertical travel.

4. The method of claim 1 wherein said second cutter cuts the needle threads when the plurality of needles are substantially at the location of the top dead point of virtual travel.

5. The method of claim 3 wherein the vertical travel of said plurality of needles is stopped at the bottom dead point when the cutting takes place by said first cutter.

6. The method of claim 4 wherein the vertical travel of said plurality of needles is stopped at the top dead point when the cutting takes place by said second cutter.

7. The method of claim 3 wherein said second cutter cuts the needle threads when the plurality of needles are substantially at the location of the top dead point of vertical travel.

8. The method of claim 7 wherein the vertical travel of said plurality of needles is stopped at the bottom dead point when the cutting takes place by said first cutter.

9. The method of claim 8 wherein the vertical travel of said plurality of needles is stopped at the top dead point when the cutting takes place by said second cutter.

10. A thread trimming device for a chain stitch type sewing machine, comprising:

a cylinder bed;

a throat plate having at least one opening on said cylinder bed and over which the material being sewn moves;

a plurality of needles each carrying a thread; means for vertically reciprocating said plurality of needles to pass through said throat plate opening;

a looper under said throat plate, means for reciprocating said looper in synchronism with the vertical motion of said needles to intertwist the looper thread with said needle threads;

first means for cutting said looper thread, at approximately the bottom of the travel of said plurality of needles; and second means for cutting all of said needle threads at approximately the top of their travel path.

11. A thread trimming device as in claim 10 wherein said means for reciprocating said plurality of needles stops the travel thereof at a top dead point and a bottom dead point, and said first and second cutting means each operate at or near the said bottom and top dead points.

12. A thread trimming device as in claim 11 wherein said first cutting means comprises:

a first fixed knife;

a first movable knife which is reciprocated in accordance with the stop of said needles at or near the bottom dead point of their travel including means for arresting the looper thread in the vicinity of the working end of said looper to pull out the looper thread, cutting said looper thread, and pressingly holding said looper thread while cooperating with said first fixed knife;

said second cutting means comprising:

a second fixed knife, a second movable knife that is reciprocated in accordance with the stop of said needles at or near the top dead point of their travel including means for entering into loops formed by the plurality of needle threads when advancing, arresting collectively said needle threads to pull out said needle threads when succeedingly retracting, and cutting said needle threads while cooperating with said second fixed knife.

13. A thread trimming device for a sewing machine according to claim 12, further comprising means for relaxing the tension of said looper thread during the operation of said first movable knife.

14. A thread trimming device for a sewing machine according to claim 12, further comprising air cylinders for driving said first and second movable knives.

15. A thread trimming device for a sewing machine according to claim 12, wherein said first and second fixed knives and said first and second movable knives are attached to the lower face of said throat plate.

16. A thread trimming device for a sewing machine as in claim 11 wherein said first and second fixed knives and said first and second movable knives are attached to the lower face of said throat plate.

* * * * *